US005415577A

United States Patent [19]

Burns

[11] Patent Number: 5,415,577

[45] Date of Patent: May 16, 1995

[54] PORTABLE MARKER AND RETRIEVER ASSEMBLY

[76] Inventor: Daniel Burns, 27 Westgate Crossing Rd., Nashva, N.H. 03062

[21] Appl. No.: 175,526

[22] Filed: Dec. 30, 1993

[51] Int. Cl.[6] ..... B63B 5/24

[52] U.S. Cl. ..... 441/6; 180/190

[58] Field of Search ..... 441/6–11, 441/23, 26, 27, 81, 131; 114/50, 51, 68; 180/190

[56] References Cited

U.S. PATENT DOCUMENTS 927,772 7/1909 Brust ..... 441/26
969,020 8/1910 Woods ..... 441/26
1,287,580 12/1918 Dumaine ..... 441/26
3,056,978 10/1962 Bradley ..... 441/8
4,523,913 6/1985 Kaino ..... 441/81
5,150,662 9/1992 Boyd et al. ..... 114/68

*Primary Examiner*—Edwin L. Swinehart

[57] ABSTRACT

A portable marker and retriever assembly is designed to be attached to a snowmobile or some similar vehicle. In one application, the assembly releases a tethered float in that situation when the snow mobile breaks through ice and sinks below the surface of a body of water. In another situation, the tether can be attached from one snowmobile to another to facilitate a towing operation.

3 Claims, 4 Drawing Sheets

PORTABLE MARKER AND RETRIEVER ASSEMBLY

BACKGROUND OF THE INVENTION

1. Field of the Invention

The present invention relates to portable marker and retriever assemblies, and more particularly pertains to a portable marker and retriever apparatus which is particularly designed for use with a snowmobile.

2. Description of the Prior Art

The use of marker-retriever assemblies is known in the prior art. For example, U.S. Pat. No. 5,156,562, which issued to Pearson at al. on Oct. 20, 1992, discloses a submerged article and retriever which is selectively mountable on a fishing rod, hand tool, or some other article to be used near water. This assembly is designed for marking and retrieving the submerged article should the article be dropped into the water, and it includes a tethered releasable buoy designed to float to the surface of the water and to be captured for the purposed for retrieving the submerged article. This patent is fully illustrative of the concept and method of use of a typical submerged marker and retriever. While being functional for its intended use, this assembly is not well adapted for use for a snowmobile whereby it could also function as a towing mechanism and accordingly, there appears to be a continuing need for new assemblies which would have additional utility beyond that of simply marking and retrieving a submerged article. In this regard, the present invention substantially fulfills this need.

SUMMARY OF THE INVENTION

In view of the foregoing disadvantages inherent in the known types of marker and retriever assemblies now present in the prior art, the present invention provides an improved marker and retriever assembly which can also be utilized as a towing mechanism, as well as a water proof storage container for selected items. As such, the general purpose of the present invention, which will be described subsequently in greater detail, as to provide a new and improved portable marker and retriever assembly which has all the advantages of the prior art and none of the disadvantages.

To attain this, the present invention generally comprises a portable marker and retriever assembly designed to be attached to a snowmobile or some similar vehicle. In one application, the assembly releases a tethered float in that situation when the snowmobile breaks through ice and sinks below the surface of a body of water. In another situation, the tether can be attached from one snowmobile to another to facilitate a towing operation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable marker and retriever assembly which may be easily and efficiently manufactured and marketed.

It is a further object of the present invention to provide a new portable marker and retriever assembly which is of a durable and reliable construction.

An even further object of the present invention is to provide a new portable marker and retriever assembly which is susceptible of a low cost of manufacture with regard to both materials and labor, and which accordingly is then susceptible of low prices of sale to the consuming public, thereby making such portable marker and retriever assemblies economically available to the buying public.

Still yet another object of the present invention is to provide a new portable marker and retriever assembly which provides in the apparatuses and methods of the prior art some of the advantages thereof, while simultaneously overcoming some of the disadvantages normally associated therewith.

Still another object of the present invention is to provide a new portable marker and reliever assembly which can also function as a towing mechanism, as well as a sealed container for selected items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
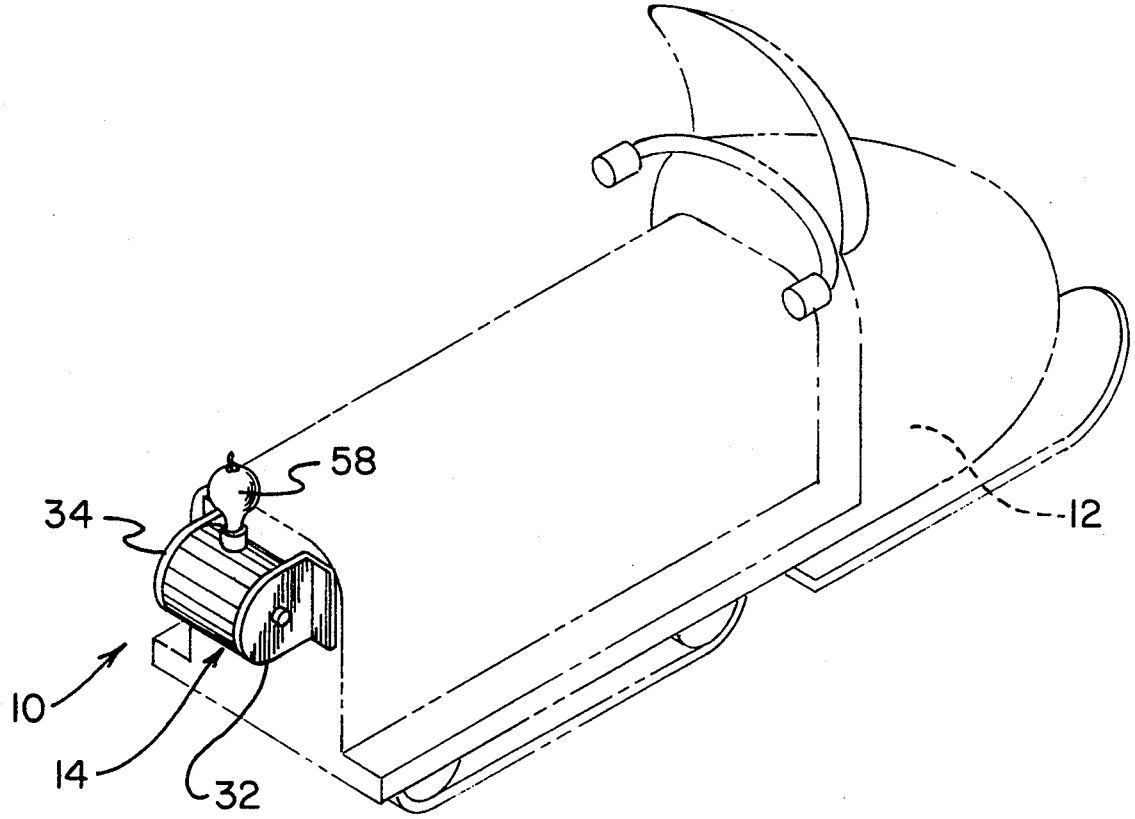
FIG. 1 is a perspective view of a snow mobile showing the portable marker and retriever assembly comprising of the present invention attached thereto.
Figure 2:
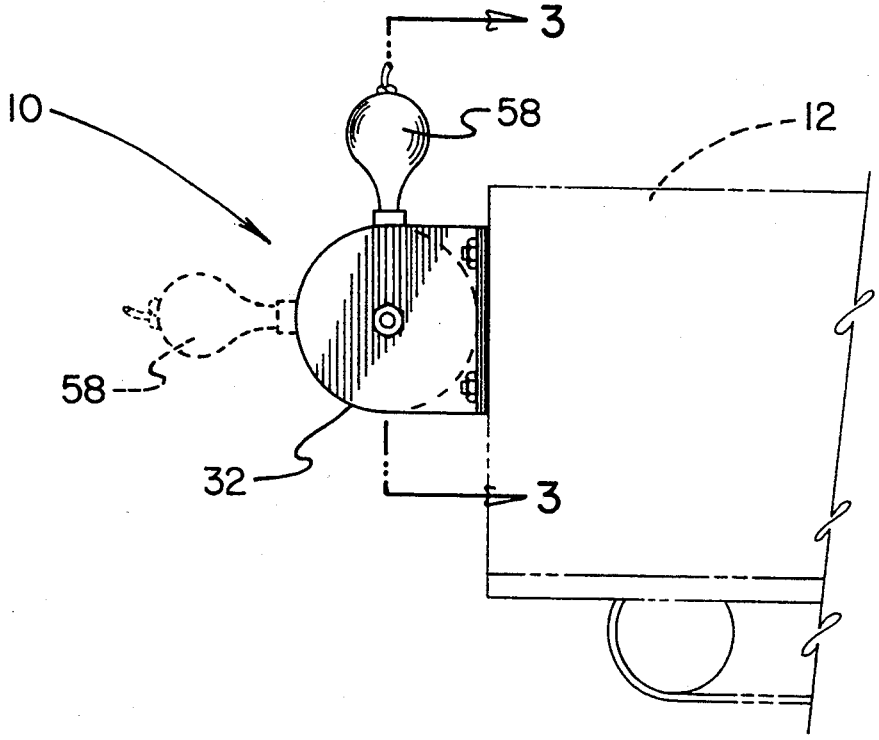
FIG. 2 is a partial side elevation view of a snow mobile illustrating an attachment and use of the invention which is attached thereto.

With reference now to the drawings, and in particular to FIGS. 1 and 2 thereof, a new portable marker and retriever assembly embodying the principles and concepts of the present invention and generally designated by the reference numeral 10 will be described.

More specifically, it will be noted that the portable marker and retriever assembly 10 is, in its preferred form, designed to be attached to a snowmobile 12 or some similar type of vehicle. While being functionally described for use on a snow mobile, it should be however, understood that the present invention could be utilized on virtually any type of apparatus which might typically need to be supplied with a marker and retriever assembly. Therefore, any representation in the present application of the invention 10 being utilized only with a snowmobile 12 should be construed within the context of the broader equivalent usages to which the present invention might be employed.

Figure 3:
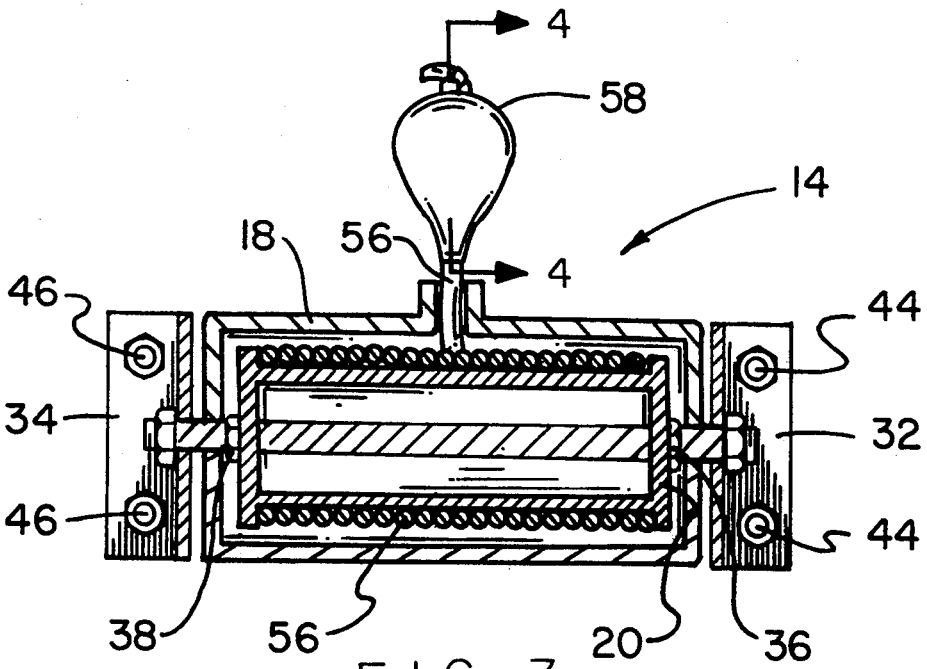
FIG. 3 is a cross-sectional view of the invention as viewed along the line 3—3 in FIG. 2.
Figure 4:
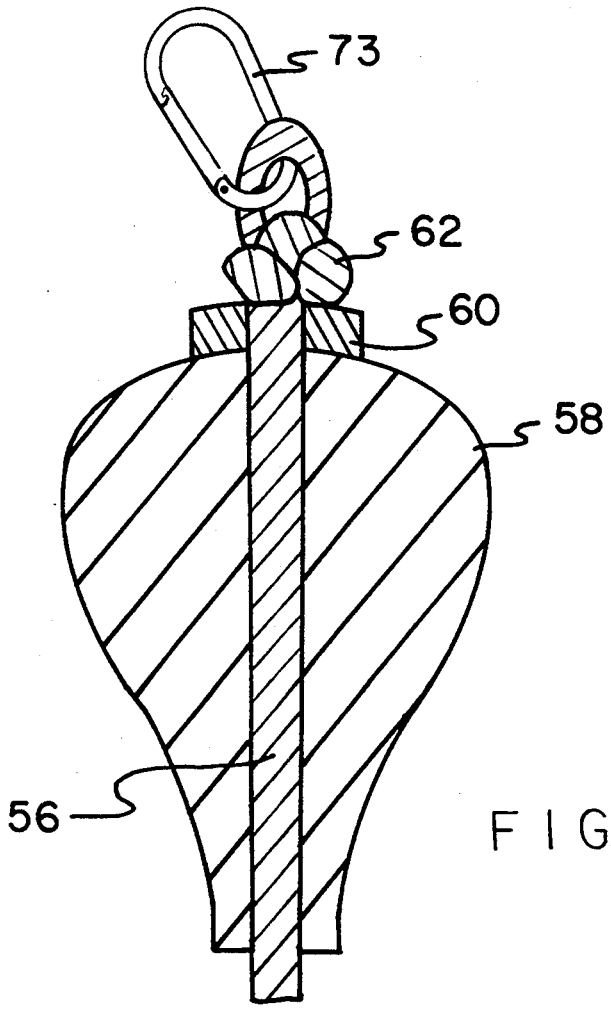
FIG. 4 is a cross-sectional view as viewed along 4—4 of FIG. 3.
Figure 5:
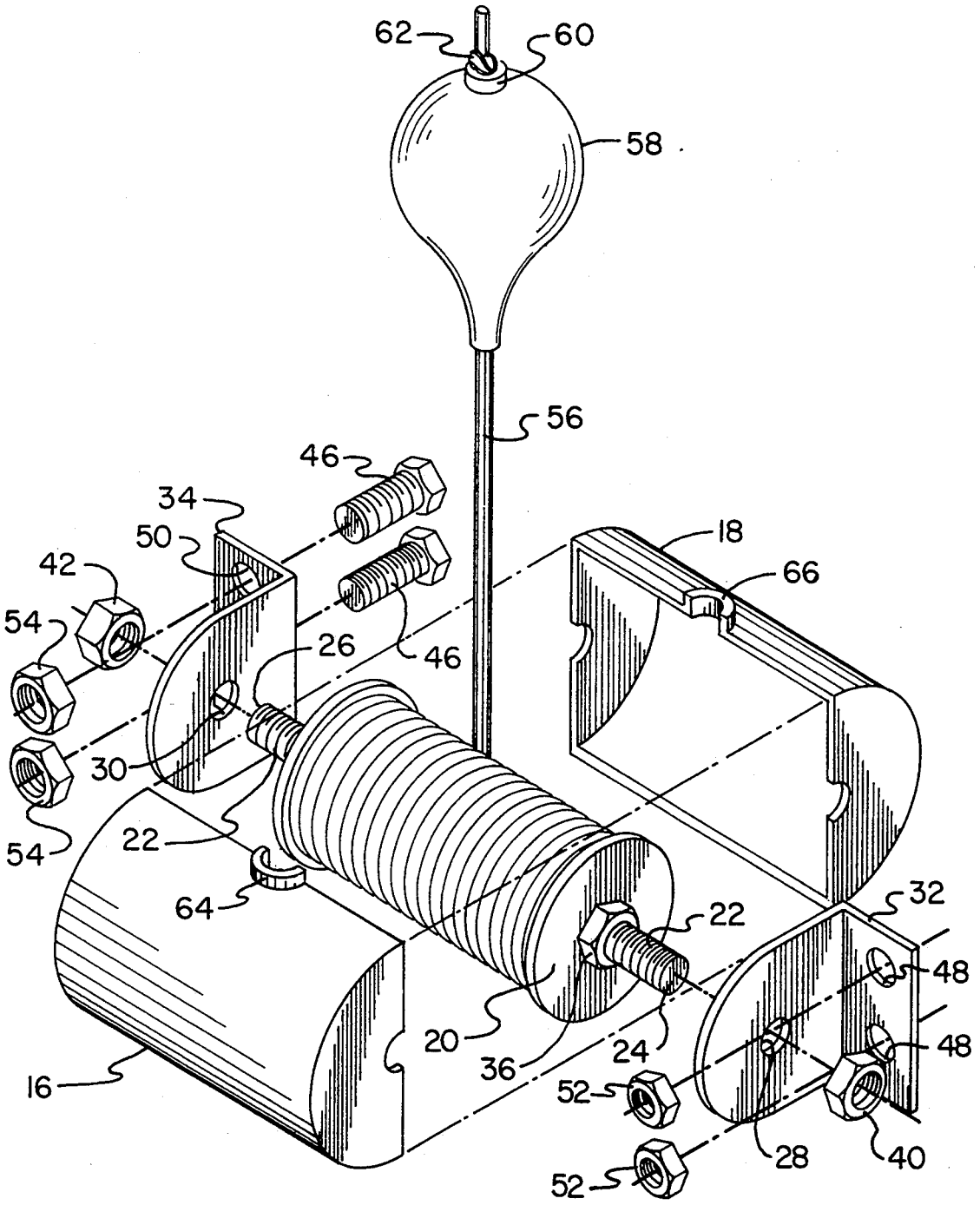
FIG. 5 is an exploded perspective view of the invention.

To understand the complete construction of the invention 10, reference in made to FIGS. 3–5 in conjunction with FIGS. 1 and 2. As shown, the invention 10 includes a housing 14 which, in a preferred embodiment, is formed of two molded halves 16, 18. The housing 14, is protectively positioned over a spool 20 which is rotatably mounted on a shaft or threaded rod 22. The threaded rod 22 has opposed threaded ends 24, 26 which are respectively positionable through apertures 28, 30 in respective angle iron supports 32, 34. Nuts 36, 38 are respectively threadably attached to the ends 24, 26 prior to the ends being inserted through the respected apertures 28, 30, and further nuts 40, 42 are then respectively threadably attached to the ends 24, 26 to effect a securement of the rod 22 to the angle iron supports 32, 34.

To mount the invention 10 to a vehicle, such as the snowmobile 12, two pairs of bolts 44, 46 are respectively positionable through further apertures 48, 50 directed through the respective angle iron supports 32, 34. An additional two pairs of nuts 52, 54 are respectively engagable with the bolts 44, 46 to effect an attachment of the angle iron supports 32, 34 to a snow mobile 12 at any desired functional location.

The spool 20 is rotatable mounted on the shaft 22 and is provided with a substantial length of braided nylon rope, preferably 6,000 pound tensile strength rope 56 which may be wrapped and stored on the spool, as sown in FIGS. 3 and 5. A tear-drop-shaped styrofoam float 58 is attached to a free end of the cord 56 and is prevented from disengagement with the cord by a fender washer 60, as well as a knot 62 formed directly in the end of the cord.

With particular reference to FIG. 5, it will be noted that the housing halves 16, 18 are of a half cylindrical form each and are so molded as to provide an aperture at respective ends through which the threaded rod 22 extends. Additionally, the halves 16, 18 are molded to each define a split conduit neck structure respectively identified by the numerals 64, 66. When the halves 16, 18 are joined together by some conventional means, such as glue or bracketry arrangements, the neck portions 64, 66 abut one another to form a conduit through which the cord 56 slidably extends.

In addition and as best illustrated in FIG. 4, the invention 10 may include a hook 73 coupled to a portion of the knot 62 such that the rope 56 may then be extended from the invention 10 and coupled to the front of another snowmobile or other vehicle, whereby a towing operation may then commence.

Figure 6:
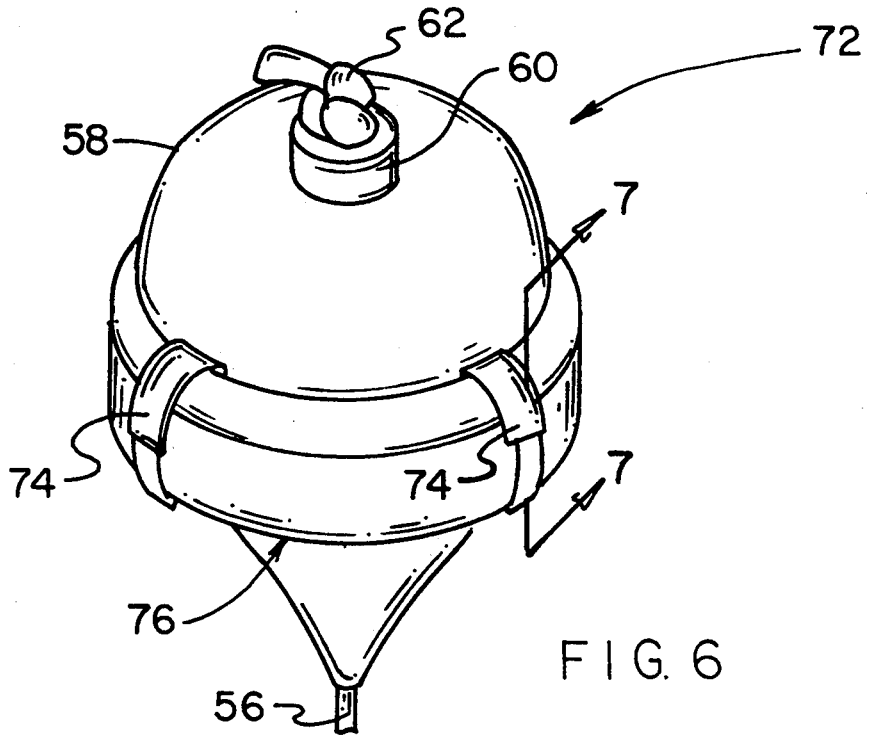
FIG. 6 is a top perspective view of the float portion of the invention illustrating a sealed emergency container attached thereto.
Figure 7:
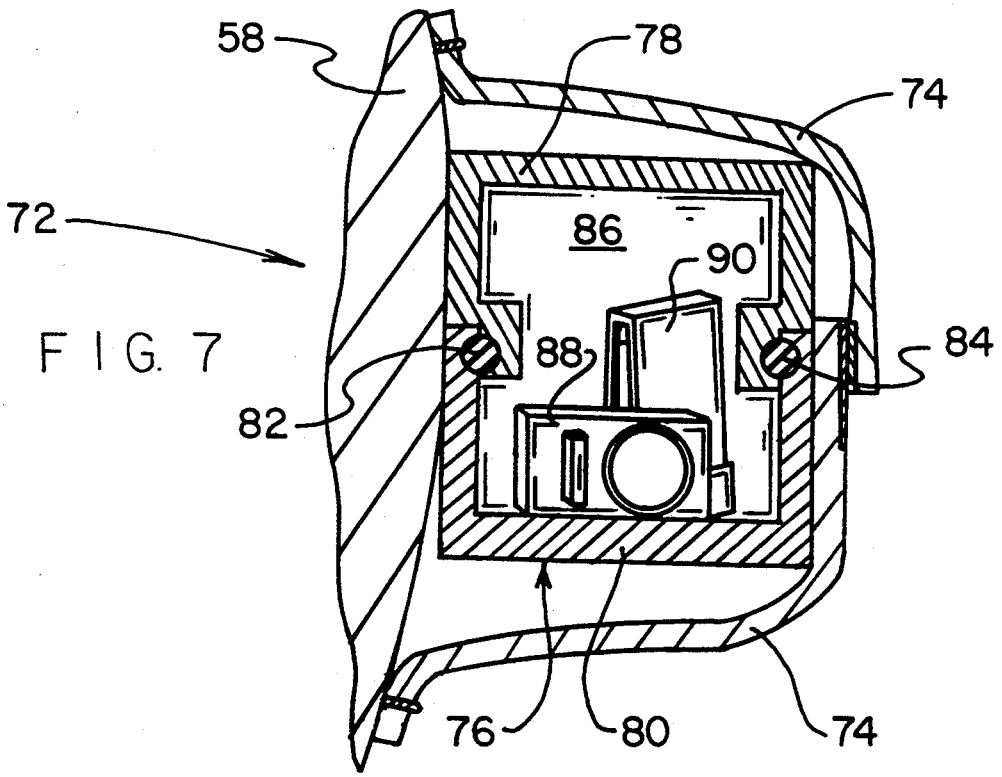
FIG. 7 is a cross-sectional view of the container as viewed as along the line 7—7 in FIG. 6.

FIGS. 6 and 7 show a modified embodiment of the invention which is generally designated by the reference numeral 72. In this modified embodiment 72, the float 58 is provided with a plurality of attached VELCRO ® straps, all of which are designated by the reference numeral 74. The straps 74 can be attached to the float 58 by any conventional means and can assume any configuration which would facilitate the attachment of a donut shaped storage container 76. The storage container 76, as best shown in FIG. 7, consists of respective top and bottom halves 78, 80 which can be snap-fitted together to form a sealed assembly. Appropriate seals 82, 84 prevent water from entering an interior chamber 86 in which various emergency use items can be stored. Such items could include a compass 88, matches 90 and a light, as well as identification documents for any other conceivable articles.

As to the manner of usage and operation of the invention 10, it can be appreciated that the portable marker and retriever assembly is in its most preferred form attached to a rear portion of a snowmobile 12, as best shown in FIG. 1. The assembly 10 is rotatably attached to the snowmobile 12, as illustrated in FIG. 2, whereby the line 56 retained within the casing 14 can either be pulled rearwardly of the snowmobile 12 as to function as a tow line or alternatively, should the snowmobile 12 falls through the ice and is completely submerged in the water, the float 58 will effectively cause the line 56 to unroll from the spool 20 so that the float can be seen on the water surface. As such, the float 58 identifies the position of the submerged snowmobile 12 to facilitate its subsequent retrieval.

In the event that the rider of the snowmobile 12 falls through the ice so as to become chilled and wet, the emergency container 76 on the float 58 will allow the rider to retrieve sealed emergency gear, such as the aforementioned matches 90 and compass 88.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A portable marker and retriever assembly comprising:

a pair of angle iron supports, each of said supports having a shaft aperture therethrough, said supports being mountable to a vehicle in a spaced relationship;

a shaft having opposed threaded ends, one of said ends projecting through said shaft aperture of one of said angle iron supports, and another of said ends projecting through said shaft aperture of another of said angle iron supports;

a spool rotatably mounted on said shaft a length of braided nylon rope wrapped around and stored on said spool, said rope having a free end;

a housing formed of two molded halves each shaped in a half cylindrical form and each having a pair of ends and a pair of apertures with one of said apertures located at one of said ends and another of said apertures located at another of said ends such that the two molded halves may be placed together around said spool, whereby such apertures allow said shaft to project exterior of said housing, said two molded halves each being further shaped so as to define a neck portion such that the two molded halves may be placed together so that the neck portions cooperatively define a conduit through which said rope slidably extends;

a tear-drop-shaped styrofoam float attached to said free end of said rope and prevented from disengagement with said rope by a knot formed directly in said free end of said rope; and, a hook attached to said free end of said rope and attachable to a further vehicle, whereby said rope may then be extended from said assembly to facilitate a towing operation of said further vehicle by said vehicle.

2. The portable marker and retriever assembly of claim 1, and further comprising a plurality of hook and loop fasteners attached to said float; and a donut shaped storage container securable around said float by said straps.

3. The portable marker and retriever assembly of claim 2, wherein said storage container comprises respective top and bottom halves which can be snap-fitted together with at least one seal positioned between said top and bottom halves to form a sealed assembly and prevent water from entering said storage container.

* * * * *